United States Patent [19]

Wilson

[11] Patent Number: 5,004,850

[45] Date of Patent: Apr. 2, 1991

[54] BLENDED GASOLINES

[75] Inventor: Ewert J. A. Wilson, Albany, Ky.

[73] Assignee: Interstate Chemical, Inc., Jupiter, Fla.

[21] Appl. No.: 447,543

[22] Filed: Dec. 8, 1989

[51] Int. Cl.[5] ..... C07C 7/20; C10L 1/16

[52] U.S. Cl. ..... 585/1; 585/1; 585/7; 585/13; 585/14; 208/16; 208/17

[58] Field of Search ..... 585/14; 208/16, 17

[56] References Cited

U.S. PATENT DOCUMENTS

| | | |
|---|---|---|
| 1,013,881 | 1/1912 | Kohn . |
| 1,014,943 | 1/1912 | Bray . |
| 1,135,506 | 4/1915 | Dubbs . |
| 1,179,001 | 4/1916 | Gay . |
| 1,429,175 | 9/1922 | Thompson . |
| 1,510,434 | 6/1923 | Hosmer . |
| 1,516,757 | 11/1924 | Weber . |
| 1,567,457 | 12/1925 | Newton . |
| 1,683,826 | 9/1928 | Huff . |
| 1,690,988 | 11/1928 | Marley et al. . |
| 1,758,590 | 5/1930 | Wilson . |
| 1,784,561 | 12/1930 | Watts et al. . |
| 1,924,196 | 8/1933 | Miller . |
| 1,954,939 | 4/1934 | Magness . |
| 2,018,778 | 10/1935 | Ebner . |
| 2,032,330 | 2/1936 | Roberts et al. . |
| 2,032,666 | 3/1936 | Roberts . |
| 2,108,659 | 2/1938 | Dunham . |
| 2,109,201 | 2/1938 | Ragatz . |
| 2,113,588 | 4/1938 | Greenewalt . |
| 2,125,325 | 8/1938 | Youker . |
| 2,184,596 | 12/1939 | Hutchinson . |
| 2,190,480 | 2/1940 | Nichols Jr. et al. . |
| 2,303,609 | 12/1942 | Carney . |
| 2,340,778 | 2/1944 | Steward et al. . |
| 2,388,732 | 11/1945 | Finsterbusch . |
| 2,560,645 | 7/1951 | Hays . |
| 3,009,789 | 11/1961 | Jordan et al. . |
| 3,371,032 | 2/1968 | Witt et al. . |
| 3,385,680 | 5/1968 | Feld et al. . |
| 4,770,747 | 9/1988 | Muller . |
| 4,773,916 | 9/1988 | Croudace et al. . |
| 4,812,146 | 3/1989 | Jessup . |

FOREIGN PATENT DOCUMENTS

| | | | |
|---|---|---|---|
| 0078292 | 5/1984 | Japan | 208/16 |

*Primary Examiner*—H. M. S. Sneed
*Assistant Examiner*—James Saba
*Attorney, Agent, or Firm*—Eckert, Seamans, Cherin & Mellott

[57] ABSTRACT

Blended gasolines are produced by the mixing of a butane-pentane rich component, a natural gasoline component, and a toluene component. The mix is weathered during the blending operation to remove light-weight hydrocarbons comprising two, three and four-carbon components. The light-weight hydrocarbons, which preferably constitute less than 3 percent of the blended gasoline, can be recovered to generate power to run the process. The liquid gasoline mixture is formulated to produce a desired octane rating, an environmentally acceptable vapor pressure, and a mix which, when burned in an internal combustion engine, produces a minimum amount of pollutants.

24 Claims, 1 Drawing Sheet

BLENDED GASOLINES

BACKGROUND OF THE INVENTION

1. Field of the Invention

The present invention relates to gasolines, and more particularly to blended gasolines.

2. Description of the Relevant Art

Petroleum reserves are decreasing, and the cost of locating and recovering new liquid gasoline reserves is increasing. Large amounts of low-weight hydrocarbon components and natural gasoline are available, but have not been extensively utilized as fuels for motor vehicles and other internal combustion engines. This is despite the relatively low cost of these fuels. These fuels have a high vapor pressure at standard temperatures and pressures, and accordingly, vapor losses to the atmosphere by open-container storage are environmentally unacceptable. These fuels are more difficult to store and to dispense than currently available gasolines, and would require modification of standard liquid gasoline burning vehicles.

SUMMARY OF THE INVENTION

It is an object of the invention to provide a fuel for internal combustion engines which utilizes low-weight hydrocarbon components and natural gasoline resources.

It is another object of the invention to provide a liquid fuel for internal combustion engines.

It is still another object of the invention to provide a fuel for internal combustion engines with an environmentally acceptable vapor pressure.

It is another object of the invention to provide a fuel for internal combustion engines with an acceptable octane rating.

It is yet another object of the invention to provide a fuel for internal combustion engines which can be produced at relatively low cost.

These and other objects are accomplished by blending a butane-pentane rich (hereinafter "low-weight hydrocarbon") component, a natural gasoline component, and a toluene component. The low-weight hydrocarbon component can comprise a mixture of hydrocarbons having from about 2 carbons to about 7 carbons in varying proportions. It is preferable, however, that at least 50 volume percent of the low-weight hydrocarbon component should be 4 and 5 carbon hydrocarbons. The natural gasoline component preferably contains hydrocarbons from about 4 to about 12 carbons. Most preferably, the natural gasoline component contains at least 65 volume percent of 5 and 6 carbon hydrocarbons and at least 25 volume percent of 7 or greater carbons. The toluene component should be relatively pure, although up to about 10 volume percent of the toluene component can be benzene and other 6 and 7 carbon hydrocarbons.

The natural gasoline and low-weight hydrocarbon components can be initially blended together in a weathering process in which light-weight hydrocarbons are withdrawn as vapor from the process. The blending is provided by one or more recirculation pumps which provide for thorough mixing of the components. The light-weight hydrocarbons which are released from the liquid blend can be burned to generate energy to power the pumps and to provide for the other energy requirements of the process. Toluene is then preferably added and mixed with the blended natural gasoline and low-weight hydrocarbon components. The weathering process continues for about 8–12 hours to allow for thorough mixing of the components and a reduction in the amount of light-weight hydrocarbons in the mixture.

The resulting product will be a liquid fuel with about 10–35 volume percent low-weight hydrocarbons, about 30–60 volume percent natural gasoline, and about 20–40 volume percent toluene. The proportions of the components can be adjusted to vary the octane rating and vapor pressure of the product gasoline.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENT

Figures 1, 2:
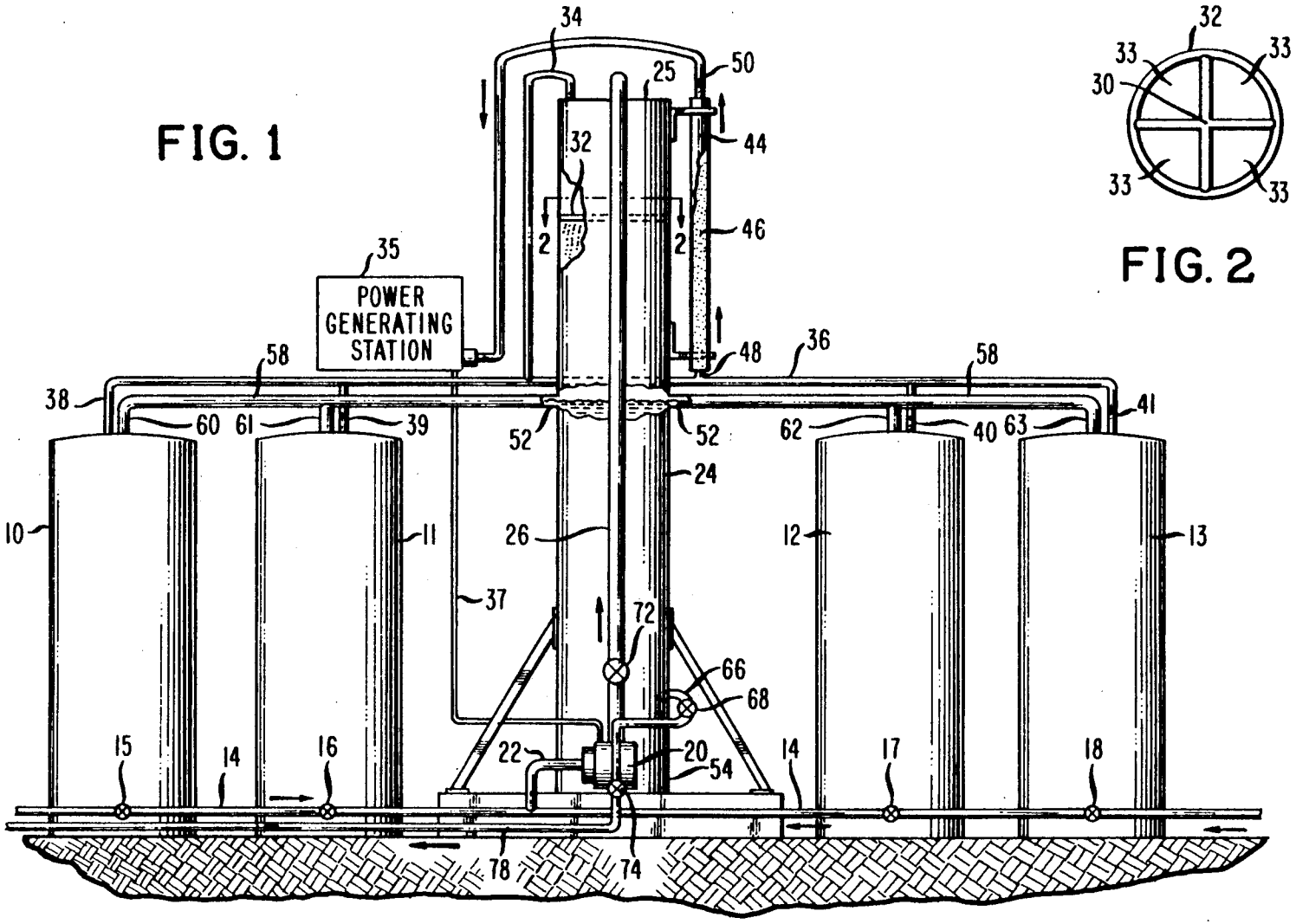
FIG. 1 is a schematic view of a process and apparatus according to the invention, partially broken away for clarity.
FIG. 2 is a cross-section taken along line 2—2 in FIG. 1.

Blended gasolines according to the invention are produced by blending a low-weight hydrocarbon component, a natural gasoline component, and a toluene component. The low-weight hydrocarbon component can contain hydrocarbons having from about 2 to more than about 7 carbons, and in varying proportions. It is preferred, however, that at least about 50 volume percent of the low-weight hydrocarbon components be butanes and pentanes. The natural gasoline component preferably comprises primarily hydrocarbons having about 4 to about 12 or more carbons. At least about 65 volume percent, however, of the natural gasoline component should be pentanes and hexanes, and at least about 25 volume percent should preferably have about 7 or more carbons. The toluene component should be at least about 90 volume percent toluene, although benzene and other low-weight hydrocarbons can be included in small proportion, which preferably does not exceed about 10 volume percent of the toluene component.

The natural gasoline components can be extracted from natural gas sources consisting mainly of methane. Most of the methane, together with ethane, propane, and some butanes, exit from the process with only the natural gasoline being condensed and collected by suitable methods known in the art, including cascade refrigeration extraction processes. These methane rich streams, free of natural gasoline components, are used principally as a fuel in homes and in power generating stations. Excess low-weight hydrocarbons can be sold separately.

It is preferable to initially blend the natural gasoline component with the low-weight hydrocarbon component. It is preferred to include about three volume percent extra of the low-weight hydrocarbon component to allow for weathering losses of ethane, propane and some butane. Light-weight hydrocarbons remaining in the mixture are weathered off during the blending operation, and can be combusted to generate power and to run pumps used in blending. The low-weight hydrocarbon component is mixed with the natural gasoline component in about a 1 to 3 volume ratio, respectively.

The components are mixed together thoroughly by suitable mixing apparatus, and a vapor stream is withdrawn from the mixture to remove light-weight hydrocarbons including ethanes, propanes and some butanes. The pressure is preferably maintained at about 0–15 psig, which allows the light-weight hydrocarbon vapors to be withdrawn from the process and passed to storage or a power generating station.

Toluene is added to the low-weight hydrocarbon/-natural gasoline mixture such that the toluene is approximately 20–40 volume percent of the mixture. The mixture is agitated to blend the mixture together and to facilitate the release of vapors. A vapor stream is again removed during the mixing process to withdraw light-weight, high vapor pressure hydrocarbons.

The liquid mix is preferably agitated in an enclosure having a vapor space. Vapor collects in the vapor space and liquid collects in a liquid space of the enclosure. The vapor stream is withdrawn from the vapor space. The agitation can be created by directing the liquid mixture into a dispersing object positioned in the enclosure. The mixing process preferably continues as a batch process for approximately 8–12 hours. Intermediate storage tanks can be provided to collect the mixture. Recirculation pumps can be utilized to return the liquid from the intermediate storage tanks to the agitation/-mixing step.

Condensing apparatus can be provided to condense low-weight hydrocarbons from the vapor stream, and these low-weight hydrocarbons can be returned to the mixing process. The condensing apparatus can be of any suitable design, but preferably has a large amount of condensing surface area. A presently preferred mixing apparatus according to the invention is shown in FIGS. 1–2. A number of storage tanks 10–13 can be provided, although more or fewer storage tanks can be provided if desired. The liquid components to be mixed can initially be stored in the tanks 10–13. Liquid exits the tanks 10–13 through a liquid return path 14 and by operation of valves 15–18. Liquid from the return path 14 enters one or more high output liquid pumps 20 through a pump inlet path 22. The pump 20 moves the liquid to an agitating apparatus, such as the mixing column 24. A riser conduit 26 conducts the liquid to the top 25 of the column 24. The liquid exits the riser conduit 26 in the downward direction, and can be directed at a center surface 30 of a splash tray 32. Liquids pass the splash tray 32 through openings 33. The splash tray 32 can be constructed from many alternative designs, but is intended to agitate the liquid to promote mixing and the release of light-weight hydrocarbon vapors. Alternative means known in the art for agitating liquids, such as impellers, pipe mixers, and packing, and for removing vapors from liquids, could also be utilized.

Vapors accumulate in, and are withdrawn from, a vapor space at the top of the mixing column 24. The vapors exit the column 24 through a vapor outlet path 34. Some vapors will condense in the vapor outlet path 34, and are returned to the tanks 10–13 through a vapor manifold 36 and vapor return paths 38–41. Vapors exiting the vapor manifold 36 are preferably processed in one or more condensation steps to condense and return to the process any low-weight hydrocarbons which may be present in the vapor stream. A condensor apparatus 44 is filled with a packing 46, which can be selected from several suitable materials and designs which will provide the requisite surface area for condensation of the low-weight hydrocarbons. Vapors can enter the condensor apparatus 44 through a packing column inlet 48 and exit through a condensor outlet 50. Liquid hydrocarbons condensed in the condensor apparatus 44 fall under the influence of gravity into the vapor manifold 36 and return to the storage tanks 10–13 through the vapor return paths 38–41. Alternative condensing operations are also possible to condense low-weight hydrocarbons from the light-weight hydrocarbon vapors.

The vapors leaving the condensor apparatus 44 through the condensor outlet 50 will consist primarily of light-weight hydrocarbons such as ethanes, propanes and some butanes. These hydrocarbons can be combusted in a suitable power generating station 35 to provide energy through a path 37 to run the circulation pumps 20, and to provide for the other energy requirements of the process.

Liquids passing through the openings 33 in the splash tray 32 collect in a bottom 54 of mixing column 24. Liquid outlets 52 are preferably provided in the sides of the mixing column 24, and are preferably spaced upwardly from the bottom 54 of the column 24. Liquid hydrocarbons will accumulate in the column to the level of the outlets 52, and will flow out of the column through the outlets 52 into one or more liquid outlet manifolds 58. Liquid in the liquid outlet manifolds 58 is returned to the storage tanks 10–13 through liquid return paths 60–63. The liquid outlets 52 may be positioned in a number of locations in the column 24 below the splash tray 32. The liquid outlets 52 are preferably positioned in the column 24 at a height greater than that of the storage tanks 10–13 to permit gravity flow of the mix from the liquid outlets 52 to the liquid return paths 60–63. Mixture accumulated in the bottom 54 of the tank 24, below the liquid outlets 52, can be recirculated to the pump 20 through a recirculation path 66, which can be controlled by operation of a valve 68.

The product gasoline is pumped from the tanks 10–13 and the column 24 when the weathering process is complete. A valve 72 in the riser path 26 can be closed, and an exit path control valve 74 is opened. The pump 20 then operates to move the gasoline through an exit path 78 to product storage tanks.

The apparatus according to the invention can be constructed from other suitable process components. The number and layout of the tanks 10–13 can be varied. Alternative pumping arrangements are also possible. It is possible to replace the column 24 with another mixing apparatus, for example, a pipe mixer apparatus, and to provide alternative means for withdrawing a vapor stream from the mixed product. It is also possible to run the process as a continuous process, as contrasted with the batch process described herein. It is also possible to utilize alternative designs to the splash tray 32. The condensor 44 can be replaced with other suitable condensor means, including chilled water condensors, to remove low-weight hydrocarbons from the vapor stream.

The proportions of natural gasoline, low-weight hydrocarbon, and toluene components can be adjusted to vary the resulting octane rating and Reid vapor pressure of the resulting gasoline. A low octane gasoline, of perhaps 87 octane, and with a Reid vapor pressure of about 12 psig and an initial boiling point of about 80 degrees F., as might be useful in a winter gasoline, would preferably have the following approximate composition:

25–35 volume percent low-weight hydrocarbons

40–50 volume percent natural gasoline
20–30 volume percent toluene

A summer gasoline mix having an octane rating of about 87 and a Reid vapor pressure of about 9 psig, together with initial boiling point of about 90 degrees F., would preferably have the following composition:

10–15 volume percent low-weight hydrocarbons
50–60 volume percent natural gasoline
20–30 volume percent toluene A winter mix gasoline having a high octane rating of approximately 92, together with a Reid vapor pressure of about 12 psig and an initial boiling point of about 80 degrees F. would preferably have the following approximate composition:

25–35 volume percent low-weight hydrocarbons
30–40 volume percent natural gasoline
30–40 volume percent toluene A summer gasoline mix having a high octane of about 92 and a Reid vapor pressure of about 9 psig, with an initial boiling point of about 90 degrees F., would preferably have the following approximate composition:

10–15 volume percent low-weight hydrocarbon
45–55 volume percent natural gasoline
30–40 volume percent toluene These proportions are preferred, but it will be understood that the preferred proportions can vary depending upon the precise composition of the various low-weight hydrocarbons, natural gasoline, and toluene components. It may be possible, for example, to substitute an alternative octane-boosting component in addition to toluene, although toluene is presently preferred.

EXAMPLE

The following example is provided for purposes of illustration, it being understood, however, that the invention is not limited to the precise compositions disclosed herein.

Feed compositions are provided having the following characteristics:

| Medium-weight Hydrocarbons | |
|---|---|
| Component | Weight % |
| Propane | 0.2 |
| Isobutane | 2.2 |
| n-butane | 25.1 |
| Hydrocarbons having 5 or more carbons | 72.5 |
| | 100.0 |
| Reid Vapor Pressure @ 100 degrees F. | 19 PSIA |
| (R + M)/2 Octane No. | 76 |
| Specific gravity @ 60 degrees F. | 0.65 |

| Natural Gasoline | |
|---|---|
| Component | Weight % |
| n-butane | 4.0 |
| i-pentane | 15.0 |
| n-pentane | 23.0 |
| hexanes | 26.0 |
| heptanes, and higher-carbon hydrocarbons | 32.0 |
| | 100.0 |
| Reid Vapor Pressure @ 100 degrees F. | 9.5 PSIA |
| (R + M)/2 Octane No. | 76 |
| Specific gravity @ 60 degrees F. | 0.75 |

| Toluene | |
|---|---|
| Component | Volume % |
| Toluene | 99.9 |
| (R + M)/2 Octane No. | greater than 100 |
| Specific gravity @ 60 degrees F. | 0.87 |

The above-described liquid components are blended by first blending the low-weight hydrocarbon component with the natural gasoline component in about a 1 to 3 volume ratio, respectively. About 3 volume percent extra of the low-weight hydrocarbon mix is added and weathered off during the blending operation. The toluene is then added to this mixture in about a 1 to 3 volume ratio, respectively. In the example embodiment, the tanks 10–13 each have a 30,000 gallon capacity. The column 24, is approximately 64 feet high, and approximately 26 inches in diameter. The riser 26, liquid manifolds 58, and conduit 16 are each 4 inch ID conduit. The vapor line 36 is 2 inch ID conduit. The pump 20 is a high output, 900 gallon per minute pump.

The pump 20 is operated to circulate the liquid components from the tanks 10–13 to the top of the column 24. The liquid components are sprayed directly onto the center 30 of the splash tray 32 to agitate the liquid and to permit vapors to separate from the liquid components. Liquid vapors exit the column 24 through the vapor outlet path 34, and low-weight hydrocarbons are recovered from the vapor in a condensor unit 44. Condensed vapors and liquid from the column 24 are returned to the tanks 10–13, and again are circulated by the pump 20. The column 24 is operated at a pressure of about 15 psig.

The mixing operation continues as a batch process for approximately 8–12 hours, until the mixture is substantially homogeneous and until the composition is approximately 15 volume percent low-weight hydrocarbons, 55 volume percent natural gasoline, and about 30 volume percent toluene. The gasoline produced by the above-described process will have a vapor pressure between about 9–12, and an octane rating of between about 87–92.

This invention can be embodied in other specific forms without departing from the spirit or essential attributes thereof, and accordingly, reference should be had to the following claims, rather than to the foregoing specification, as indicating the scope of the invention.

I claim:

1. A process for producing gasoline, comprising the steps of:

(a) blending liquid components comprising a low-weight hydrocarbon component, a natural gasoline component, and a toluene component; and, (b) withdrawing a vapor stream of light-weight hydrocarbons from said liquid components, whereby the vapor pressure of the resulting blended liquid product will be decreased.

2. The process of claim 1, wherein said blending step (a) comprises an initial blending step wherein said low-weight hydrocarbon component is blended with said natural gasoline component to produce an intermediate blended product, said intermediate blended product subsequently being blended with said toluene component.

3. The process of claim 1, wherein said blending step (a) comprises the agitation of said liquid components, whereby said vapor withdrawal step (b) will be facilitated.

4. The process of claim 3, wherein said agitation step comprises the step of directing a stream of said liquid components against a solid object in an enclosure having a vapor space, said vapor stream being withdrawn from said vapor space.

5. The process of claim 4, wherein said agitation step comprises the step of pumping said liquid components to the top of a column, and directing a stream of said liquid components downwardly against a splash tray within said column, said liquid components collecting in a bottom, liquid space portion of said column, said vapors accumulating in an upper, vapor space portion of said column, said vapor stream being withdrawn from said vapor space portion of said column.

6. The process of claim 5, wherein said vapor stream of step (b) is subjected to a condensation step, liquid product from said condensation step being returned to said blending step (a).

7. The process of claim 6, wherein said condensation step comprises passing said vapor stream through an enclosure having high surface area condensation means.

8. The process of claim 7, wherein said condensation step comprises passing said vapor stream through a condensation column containing packing.

9. The process of claim 1, wherein said process is performed as a batch operation.

10. The process of claim 9, wherein said process continues as a batch operation for between about 8 and about 12 hours.

11. The process of claim 1, wherein said process is performed at pressures of between about 0 and about 15 psig.

12. The process of claim 1, wherein vapors removed from said vapor withdrawal step (b) are passed to a power generating station, said vapors being combusted by power-generating means to generate power to run said process.

13. The process of claim 1, wherein liquid product from said blending step (a) is passed to intermediate storage tanks, liquid from said storage tanks being returned to said blending step (a) through a continuous recycling process.

14. The process of claim 1, wherein said blending step (a) continues until the composition of said liquid comprises between about 10 and about 35 volume percent low-weight hydrocarbons, between about 30 and about 60 volume percent natural gasoline, and between about 20 and about 40 volume percent toluene.

15. The process of claim 1, wherein said process produces a winter, low-octane gasoline, said process continuing until the composition of said product comprises between about 25 and about 35 volume percent low-weight hydrocarbons, between about 40 and about 50 volume percent natural gasoline, and between about 20 and about 30 volume percent toluene.

16. The process of claim 1, said process producing a winter, high-octane gasoline, said process continuing until said liquid composition comprises between about 25 and about 35 volume percent low-weight hydrocarbons, between about 30 and about 40 volume percent natural gasoline, and between about 30 and about 40 volume percent toluene.

17. The process of claim 1, said process producing a summer, low-octane gasoline, said process continuing until said liquid composition comprises between about 10 and about 15 volume percent low-weight hydrocarbons, between about 50 and about 60 volume percent natural gasoline, and between about 20 and about 30 volume percent toluene.

18. The process of claim 1, wherein said process produces a summer, high-octane gasoline, said process continuing until said liquid composition comprises between about 10 and about 15 volume percent low-weight hydrocarbons, between about 45 and about 55 volume percent natural gasoline, and between about 30 and about 40 volume percent toluene.

19. A process for producing gasoline, comprising the steps of:

(a) blending liquid components comprising a low-weight hydrocarbon component and a natural gasoline component in about a 1 to 3 volume ratio, respectively, and a toluene component in about a 1 to 3 volume ratio to both of said low-weight hydrocarbon component and said natural gasoline component;

(b) agitating said liquid components of step (a) by directing a stream of said liquid components against a splash tray in an enclosure having a vapor space substantially above said splash tray and a liquid space substantially below said splash tray, said liquid components collecting in a bottom, liquid space portion of said enclosure, vapors accumulating in said vapor space portion of said enclosure, said vapor stream being withdrawn from said vapor space portion of said enclosure;

(c) a condensation step in which said low-weight hydrocarbons present in said vapor stream are condensed and returned to said blending step (a), said condensation step further producing a light weight hydrocarbon vapor product;

(d) said light-weight hydrocarbon vapor product of said condensation step (c) being burned to generate power, said power being utilized to provide energy for said agitation step (b); and, (e) said process continuing until said liquid components have a composition of between about 10 and about 35 volume percent low-weight hydrocarbons, between about 30 and about 60 volume percent natural gasoline, and between about 20 and about 40 volume percent toluene.

20. A method of blending gasoline components, comprising the steps of:

(a) blending said liquid gasoline components in an enclosure having a vapor space; and (b) withdrawing a vapor stream from said vapor space of said enclosure to lower the vapor pressure of the resulting blended liquid gasoline product.

21. The blending process of claim 20, wherein said liquid product (a) is agitated, whereby said vapor withdrawal will be facilitated.

22. The blending process of claim 21, wherein said blending step (a) comprises the step of directing a stream of said liquid components against a solid object in said enclosure, liquid product from said enclosure being returned to said directed stream by a recycle path, and vapors being withdrawn from said vapor space.

23. The process of claim 22, wherein said vapors withdrawn from said vapor space are passed to a power-generating station and utilized to generate power to run said process.

24. An energy self-sufficient gasoline producing process, comprising the steps of:

(a) blending components of said gasoline in an enclosure having a vapor space;

(b) withdrawing vapors from said vapor space; and, (c) passing said vapors to a power-generating station, and combusting said vapors in said power generating station to generate power for said blending step (a).

* * * * *